US007562770B1

(12) United States Patent
Roque

(10) Patent No.: US 7,562,770 B1
(45) Date of Patent: Jul. 21, 2009

(54) DRINK HOLDER

(76) Inventor: Nelson B. Roque, 2 Tuscan B. Roque, American Canyon, CA (US) 94503

( * ) Notice: Subject to any disclaimer, the term of this patent is extended or adjusted under 35 U.S.C. 154(b) by 190 days.

(21) Appl. No.: 11/681,013

(22) Filed: Mar. 1, 2007

(51) Int. Cl.
*B65D 25/08* (2006.01)

(52) U.S. Cl. ..... 206/221; 206/219; 206/568

(58) Field of Classification Search ..... 206/219, 206/221, 568
See application file for complete search history.

(56) References Cited

U.S. PATENT DOCUMENTS

| | | | | |
|---|---|---|---|---|
| 5,020,690 | A * | 6/1991 | Kishikawa et al. | 222/83 |
| 5,246,142 | A * | 9/1993 | DiPalma et al. | 222/129 |
| 5,419,445 | A * | 5/1995 | Kaesemeyer | 215/11.1 |
| 6,372,270 | B1 | 4/2002 | Denny | |
| 6,609,612 | B2 | 8/2003 | Vlodek | |
| 6,705,490 | B1 * | 3/2004 | Lizerbram et al. | 222/145.1 |
| 6,705,491 | B1 * | 3/2004 | Lizerbram et al. | 222/145.1 |
| 6,854,595 | B2 | 2/2005 | Kiser | |
| 7,073,686 | B2 * | 7/2006 | Hanell | 222/83.5 |
| 2003/0072850 | A1 | 4/2003 | Burniski | |
| 2003/0132244 | A1 * | 7/2003 | Birkmayer et al. | 222/83 |
| 2004/0161504 | A1 | 8/2004 | Daniels et al. | |
| 2006/0108135 | A1 * | 5/2006 | Cho | 173/128 |

* cited by examiner

*Primary Examiner*—J. Gregory Pickett
*Assistant Examiner*—Jenine M Pagan
(74) *Attorney, Agent, or Firm*—Crossley Patent Law; Mark A. Crossley

(57) ABSTRACT

A drink holder that includes a base with a volume of water in it and a two-part cap that can be rotated to drop an amount of powdered drink mix, stored within the cap, into the water within the base. The cap includes a bottom section, a top section attached to the bottom section, and a cap that is placed on top of the top section. The bottom section has a flange that sticks out and meets the flange from the top section, forming a small compartment above the two flanges within the cap. The flanges are in this position when the top section of the cap is tightly connected to the bottom section of the cap. When the top section is threadably detached form the bottom section, the positioning of the two flanges creates a rather large hole within the cap, causing any drink powder or mix within an upper section of the cap to fall down through the bottom section of the cap and into the volume of liquid (preferably water).

1 Claim, 3 Drawing Sheets

DRINK HOLDER

BACKGROUND OF THE INVENTION

The present invention concerns that of a new and improved drink holder that includes a base with a volume of water in it and a two-part cap that can be rotated to drop an amount of powdered drink mix, stored within the cap, into the water within the base.

DESCRIPTION OF THE PRIOR ART

U.S. Pat. No. 6,609,612 B2, issued to Viodek, discloses a closure for a beverage receptacle that includes a selectively operable dispense feature.

U.S. Pat. No. 6,854,595 B2, issued to Kiser, discloses a container closure to be attached to a liquid container around a container opening of a liquid container.

United States Application No. 2003/0072850, filed by Burniski, discloses a drink mix dispenser that includes a reservoir for drink mix and a stopper for the reservoir, all incorporated into a bottle cap.

United States Application No. 2004/0161504 A1, filed by Daniels et al., discloses a mineral-fortification system that has a bottle cap, a pouch, and a pouch opener.

U.S. Pat. No. 6,372,270 B1, issued to Denny, discloses a invention that comprises various methods and apparatus for making or brewing personal quantities of beverages using bottled water, either in conventional or specially formed bottle.

SUMMARY OF THE INVENTION

The present invention concerns that of a new and improved drink holder that includes a base with a volume of water in it and a two-part cap that can be rotated to drop an amount of powdered drink mix, stored within the cap, into the water within the base. The cap includes a bottom section, a top section attached to the bottom section, and a cap that is placed on top of the top section. The bottom section has a flange that sticks out and meets the flange from the top section, forming a small compartment above the two flanges within the cap. The flanges are in this position when the top section of the cap is tightly connected to the bottom section of the cap. When the top section is threadably detached form the bottom section, the positioning of the two flanges creates a rather large hole within the cap, causing any drink powder or mix within an upper section of the cap to fall down through the bottom section of the cap and into the volume of liquid (preferably water).

There has thus been outlined, rather broadly, the more important features of a drink holder that the detailed description thereof that follows may be better understood and in order that the present contribution to the art may be better appreciated. There are, of course, additional features of the drink holder that will be described hereinafter and which will form the subject matter of the claims appended hereto.

In this respect, before explaining at least one embodiment of the drink holder in detail, it is to be understood that the drink holder is not limited in its application to the details of construction and to the arrangements of the components set forth in the following description or illustrated in the drawings. The drink holder is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present drink holder. It is important, therefore, that the claims be regarded as including such equivalent constructions insofar as they do not depart from the spirit and scope of the present invention.

It is therefore an object of the present invention to provide a drink holder which has all of the advantages of the prior art and none of the disadvantages.

It is another object of the present invention to provide a drink holder which may be easily and efficiently manufactured and marketed.

It is another object of the present invention to provide a drink holder which is of durable and reliable construction.

It is yet another object of the present invention to provide a drink holder which is economically affordable and available for relevant market segment of the purchasing public.

Other objects, features and advantages of the present invention will become more readily apparent from the following detailed description of the preferred embodiment when considered with the attached drawings and appended claims.

DESCRIPTION OF THE PREFERRED EMBODIMENT

Figure 1:
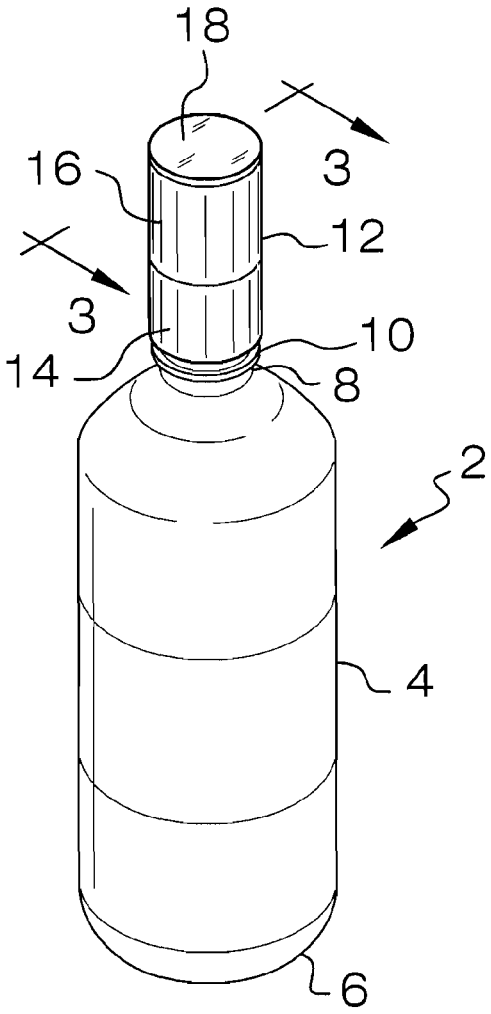
FIG. 1 shows a perspective view of the drink holder as it would appear in use.
Figure 2:
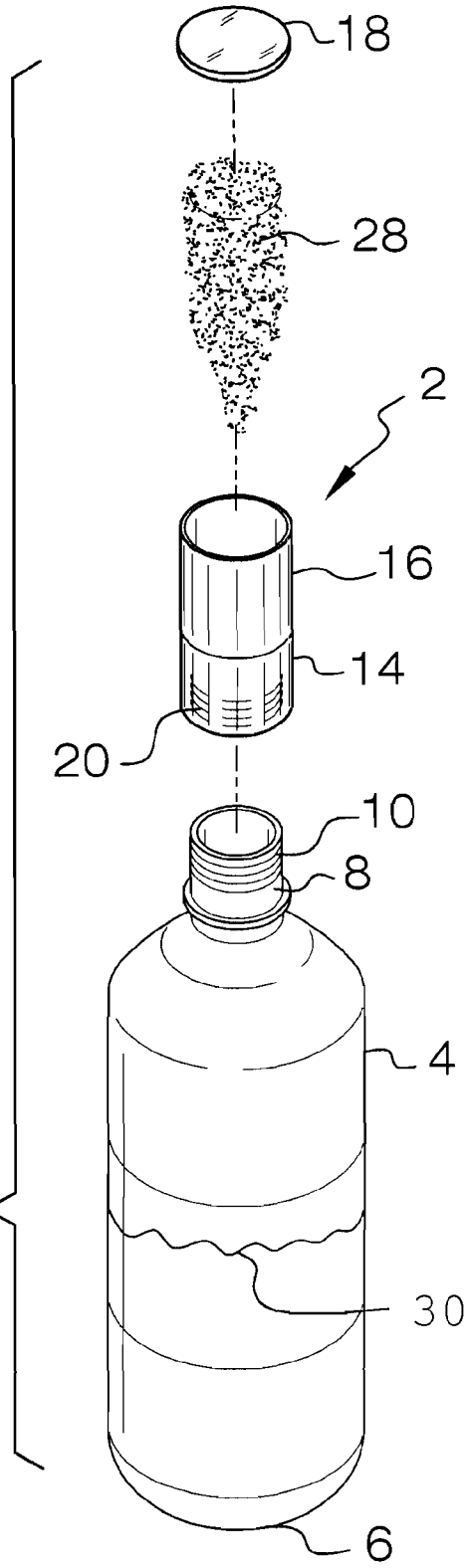
FIG. 2 shows a perspective view of the various parts of the drink holder as it would appear in use.
Figure 3:
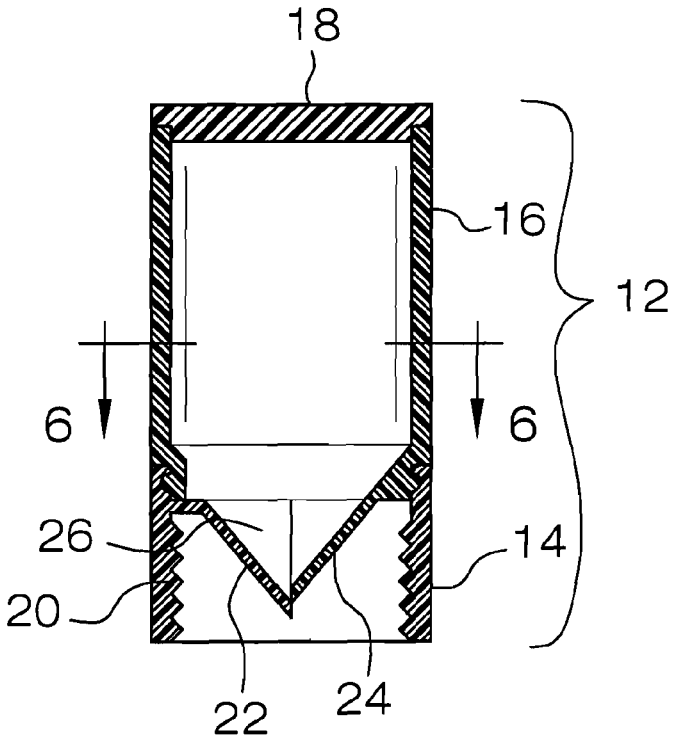
FIG. 3 shows a side cutaway view of the inside of a cap.
Figure 4:
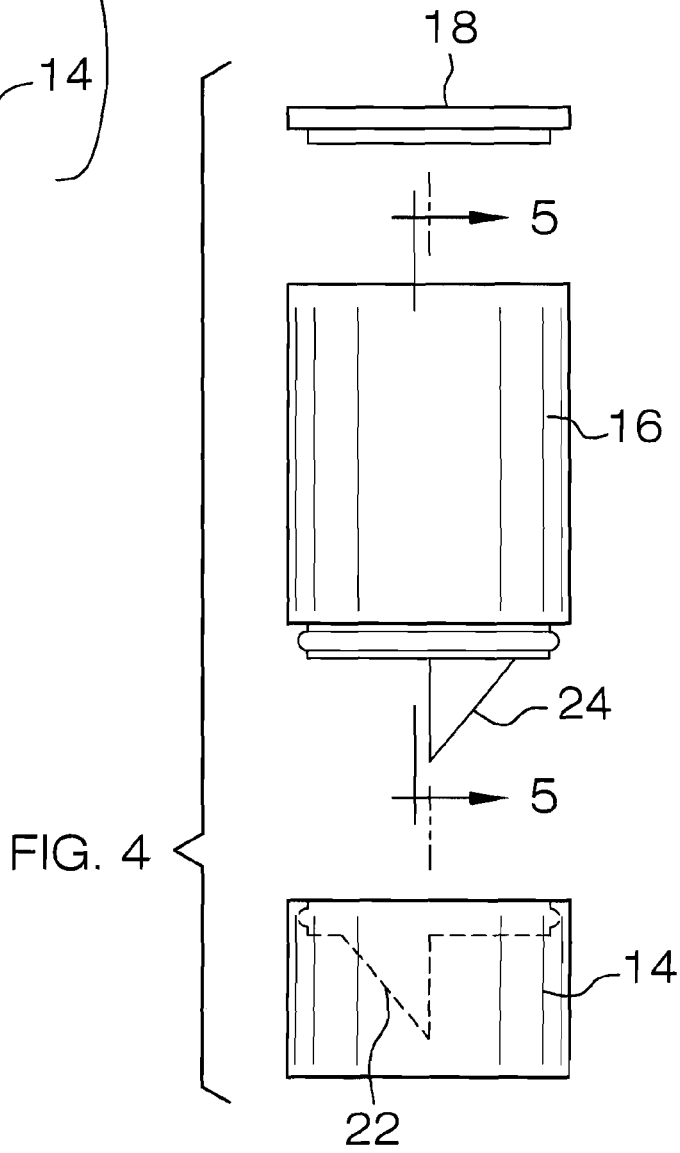
FIG. 4 shows a representational view of the top section of the cap and the lid as they are being attached to the bottom section of the cap.
Figure 5:
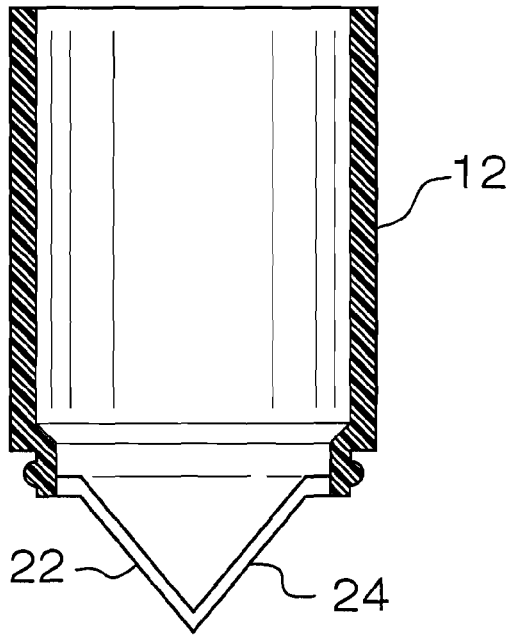
FIG. 5 shows a side cutaway view of the top section of the cap and the two flanges as they are seen when they are connected to one another.
Figure 6:
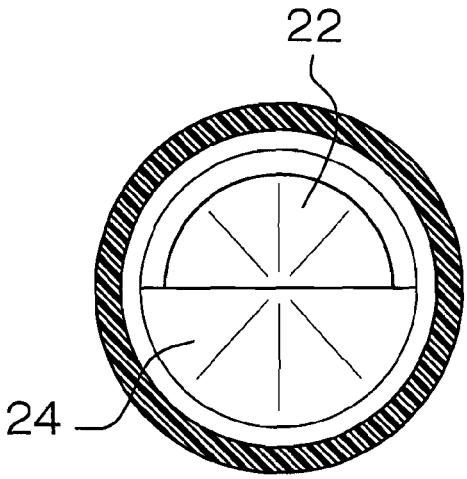
FIG. 6 shows a top view of the cap, highlighting the position of the two flanges when the top section of the cap is tightly threadably connected to the bottom section of the cap.
Figure 7:
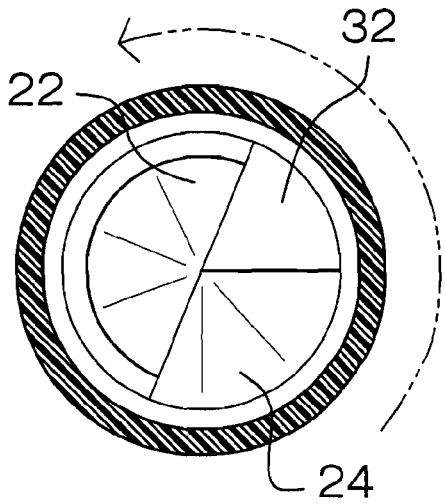
FIG. 7 shows a top view of the cap, highlighting the position of the two flanges when the top section of the cap is loosened up a bit and there is a hole in which powder within the cap can fall down into the water within the attached water bottle.

With reference now to the drawings, and in particular to FIGS. 1 through 7 thereof, a new drink holder embodying the principles and concepts of the present invention and generally designated by the reference numeral 2 will be described.

As best illustrated in FIGS. 1 through 7, the drink holder 2 comprises a bottle 4, with the bottle 4 having a base 6 and a top opening 8. The top opening 8 has a plurality of external male threads 10 on it. The bottle 4 is preferably circular but can have other shapes as well.

Also associated with the drink holder 2 is a covering 12, with the covering 12 capable of being attached to the top opening 8. The covering 12 itself is fabricated from three parts which are a bottom section 14, a top section 16 attached to the bottom section 14, and a cap 18 that is placed on top of the top section.

The bottom section 14 has two ends comprising a top end and a bottom end, with the bottom end having a plurality of internal threads 20. These internal threads 20 are used to threadably attach the covering 12 to the drink holder and are located within the inside of bottom section 14 near the bottom end of bottom section 14. The bottom section 14 also has a flange 22 that sticks out within the inside of bottom section 14.

The top section 16 has two ends comprising a top end and a bottom end, with the bottom end of the top section 16 capable of being removably attached to the top end of the bottom section 14. An internal flange 24 is located within the inside of top section 16, with this flange 24 pointing downward outside the bottom end of the top section 16.

When the top section 16 is removably attached to the bottom section 14, the internal flange 24 within the top section 16 and the flange 22 located within the bottom section 14, taken together, form a pocket 26 in which an amount of powdered drink mix 28 can be placed. The drink mix 28 is, in this position, not yet mixed with the volume of water 30 that would be located within the bottle 4. A cap 18 can be removably attached to the top end of the top section 16.

When an individual would want to mix the drink mix 28 with the volume of water 30, however, he or she would merely twist the top section 16 in relation to the bottom section 14, perhaps about one-quarter to one-half of a turn. This would create an opening 32 below the pocket in relation to the area of the bottle 4 below, allowing the drink mix 28 to fall into the volume of water 30 and be mixed with this volume of water 30. Providing the covering 12 is appropriately attached to the top end of the top section 16, the individual could then shake the drink holder 2 to blend the water 30 and the drink mix 28, allowing a powdered drink to be created. The entire covering 12 could then be removed and the resulting mixture could be drunk as needed and when desired.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A drink holder comprising:

a bottle, the bottle including a base, a volume of liquid within the bottle, a top opening on the bottle, means for covering the top opening, means for storing an amount of powdered drink mix, and means for creating a drinkable mixture with the combination of the volume of water and the means for storing the amount of powdered drink mix, wherein the volume of liquid within the bottle further comprises a volume of water, wherein the means for covering the top opening further comprises a covering, the covering comprising:

a bottom section having two ends comprising a top end and a bottom end, a top section having two ends comprising a top end and a bottom end, the top end of the top section stacked atop the bottom end of the top section, wherein the bottom end of the top section is removably attached to the top end of the bottom section, a cap attached to the top end of the top section, and means for threadably attaching the bottom end of the bottom section to the top opening on the bottle, wherein the means for threadably attaching the bottom end of the bottom section to the top opening on the bottle further comprises a plurality of external threads located on the top opening of the bottle, a plurality of internal threads located within the bottom section of the covering near the bottom end of the bottom section, wherein the bottom end of the bottom section can be placed adjacent to the top opening on the bottle, and further wherein the plurality of external threads located on the top opening of the bottle can be removably attached to the plurality of internal threads located within the bottom section of the covering near the bottom end of the bottom section;

wherein the means for storing an amount of powdered drink mix further comprises a downwardly angled first flange located within the bottom section, a downwardly angled second flange located within the top section, wherein the two flanges form a pocket above the bottle, wherein an amount of powdered drink mix can be placed within the pocket wherein turning the top section of the covering in relation to the bottom section of the covering, provides an opening in between the pocket and the bottle, such that the powdered drink mix may fall into the volume of liquid within the bottle.

* * * * *